United States Patent [19]

Okazaki

[11] Patent Number: 4,655,626

[45] Date of Patent: Apr. 7, 1987

[54] ELECTRONIC PRINTER EQUIPPED WITH DETECTING DEVICE FOR AN EXCHANGEABLE SHEET SUPPLYING UNIT

[75] Inventor: Ryota Okazaki, Tokyo, Japan

[73] Assignee: NEC Corporation, Tokyo, Japan

[21] Appl. No.: 748,643

[22] Filed: Jun. 25, 1985

[30] Foreign Application Priority Data

Jun. 25, 1984 [JP] Japan ..... 59-130756

[51] Int. Cl.[4] ..... B41J 11/50

[52] U.S. Cl. ..... 400/605; 400/708; 400/616.1; 400/608.2; 271/259

[58] Field of Search ..... 400/703, 596, 706, 707.5, 400/707.7, 708, 708.1, 637.1, 639.1, 54, 616.1, 616.2, 707.1, 707, 605, 608.1, 608.2; 355/14 SH; 271/258, 259

[56] References Cited

U.S. PATENT DOCUMENTS

| | | | |
|---|---|---|---|
| 2,372,892 | 4/1945 | Ghertman | 400/708.1 |
| 3,430,748 | 3/1969 | Parri | 400/708 X |
| 4,260,244 | 4/1981 | Laska et al. | 355/88 |
| 4,268,021 | 5/1981 | Rutishauser et al. | 400/708 |
| 4,560,990 | 12/1985 | Sue et al. | 346/136 |
| 4,565,462 | 1/1986 | Yamamoto et al. | 400/708 |

FOREIGN PATENT DOCUMENTS

| | | | |
|---|---|---|---|
| 3305341 | 9/1983 | Fed. Rep. of Germany | 400/708 |
| 48103 | 3/1981 | Japan | 400/708 |
| 11075 | 1/1982 | Japan | 400/708 |
| 1582 | 1/1983 | Japan | 400/708 |
| 62080 | 4/1983 | Japan | 400/708 |
| WO82/01514 | 5/1982 | PCT Int'l Appl. | 400/708 |

*Primary Examiner*—E. H. Eickholt

*Attorney, Agent, or Firm*—Sughrue, Mion, Zinn, Macpeak, and Seas

[57] ABSTRACT

An electronic printer capable of operating in a manual feed mode and being adapted to operate in two automatic feed modes, a first involving operation with a continuous sheet, tractor feed mechanism and a second involving operation with stacked sheet mechanism. Mechanical attachment of either auto feed mechanisms to the printer results in the operation of detector switches on the printer that identify the presence of an auto-feed and the type of unit being attached. The printer also has a detection mechanism to identify the presence or absence of sheets in an attached auto feed unit. The detection mechanism is generally a spring-loaded mechanical linkage between a roller and an electrical switch, when the roller is adapted to drop into a window on the surface of a sheet feed platen when no sheet is present. The printer unit detects the condition of the switches, all of which are on the printer unit, and controls its operation in response thereto.

9 Claims, 8 Drawing Figures

ELECTRONIC PRINTER EQUIPPED WITH DETECTING DEVICE FOR AN EXCHANGEABLE SHEET SUPPLYING UNIT

BACKGROUND OF THE INVENTION

The present invention relates to an electronic printer having a sheet-supplying unit for delivering a print paper in front of a printer head, and more particularly to a detecting device for detecting the kind of the sheet-supplying unit which is selectively attached to the printer.

A print paper on which characters are printed is required to be loaded on a serial or line printer in either form of a cut sheet and a continuous sheet. The sheet-supplying unit for the cut sheet is called as a sheet-feeler or a cut sheet feeding unit, and a tractor unit is employed for feeding the continuous sheet into and out of the printer. The U.S. Pat. No. 4,489,126 discloses a serial printer with a tractor unit. The tractor unit has a plurality of feed pins which engages the apertures formed on the both sides of the continuous sheet. The sheet is fed by the tractor unit so as to be wound around a cylindrical platen. The tractor unit is intermittently actuated each printing operation is completed to advance the sheet by one line. The platen is driven in synchronism with the tractor unit to feed the continuous sheet together with the tractor unit.

On the other hand, the serial printer disclosed in the U.S. Pat. No. 4,438,915 employs a sheet feeding unit for transporting a cut sheet to the printer. The sheet feeding unit has a sheet stacker for storing piled cut sheets and kick out rollers for picking up one of the sheets and delivering it in front of the printer head. The transported sheet is wound around a platen and pressed on the face of the platen by pressure rollers. The platen intermittently rotates by one printing line after each printing of a line is completed to advance the cut sheet.

It is desired that the printer can print on both the continuous sheet and the cut sheet. To this end, in the serial printer sold under the trademark "SPIN-WRITER" 3500 series, the two kinds of sheet-supplying units, i.e., the tractor unit and the cut sheet feeding unit are exchangeably provided on the print unit of the printer. The print unit mainly comprises a printing mechanism and a platen for moving the sheet in the printer and is required to feed the sheet in different manner in accordance with the kind of the sheet-supplying unit. Namely, when the tractor unit is attached, the print unit may simply advance the continuous sheet stepwise in response to the printing operation. On the other hand, when the cut sheet feeding unit is attached, the print unit automatically feeds the cut sheet in a certain length at first, such that the first print line of the sheet is transferred at printing position, and then, advances the sheet stepwise in response to the printing operation, and finally, moves the sheet out of the printer after the printing on that sheet is completed.

In order to perform the different control of the sheet feeding, the print unit is necessary to recognize the kind of the sheet-supplying unit attached thereto. Heretofore, the tractor unit and the sheet feeding unit have had an electrical signal line, respectively, to be connected to the print unit of the printer, through which an electrical signal is transmitted to the print unit for informing the print unit of what kind of sheet-supplying unit is being used. Accordingly, the signal line must be connected electrically to the print unit when the tractor or cut sheet feeding unit is mechanically connected to the print unit. Therefore, exchanging operation of the sheet-supplying unit is complicated.

Further, the sheet-supplying unit is required to detect the absence of the sheet so as to prevent the printer from printing on a bare platen. In the prior art printer, each of the tractor unit and the cut sheet feeding unit has a mechanical switch or an optical sensor for detecting the absence of the sheet. The detector signal is supplied to the print unit via the signal line connected to the print unit. The necessity of the mechanical switches or the optical sensors on the two sheet-supplying units increases the manufacturing cost of the sheet-supplying units and decreases the durability of the same owing to breaking down of the switch or the sensor.

SUMMARY OF THE INVENTION

Therefore, an object of the present invention is to provide a printer equipped with a detecting device for an exchangeable sheet-supplying unit.

Another object of the present invention is to provide an electronic printer in which the exchanging operation of the sheet-supplying units can be simplified by getting rid of the signal line for informing the kind of sheet-supplying unit to the print unit of the printer.

Further object of the present invention is to provide an electronic printer capable of detecting the presence or absence of a print paper without switching means provided on each of the two sheet-supplying units.

A printer according to the present invention comprises a printing mechanism capable of printing on either one of a continuous sheet and a cut sheet, an automatic sheet setting mechanism for feeding the cut sheet to the printing mechanism, an actuating switch means taking first and second states and for enabling the automatic sheet setting mechanism to operate in the first state, means adapted to receive either one of two different sheet-supplying unit, and a detecting switch means operated by each of the sheet-supplying units to take a third state in response to one of the sheet-supplying units and a fourth state in response to the other of the sheet-supplying units.

BRIEF DESCRIPTION OF THE DRAWINGS

The above-mentioned and other objects, features and advantages of the present invention will be better understood from the following detailed description of a preferred embodiment of the present invention taken in conjunction with the accompanying drawings, wherein.

DESCRIPTION OF THE PREFERRED EMBODIMENT

Figure 1:
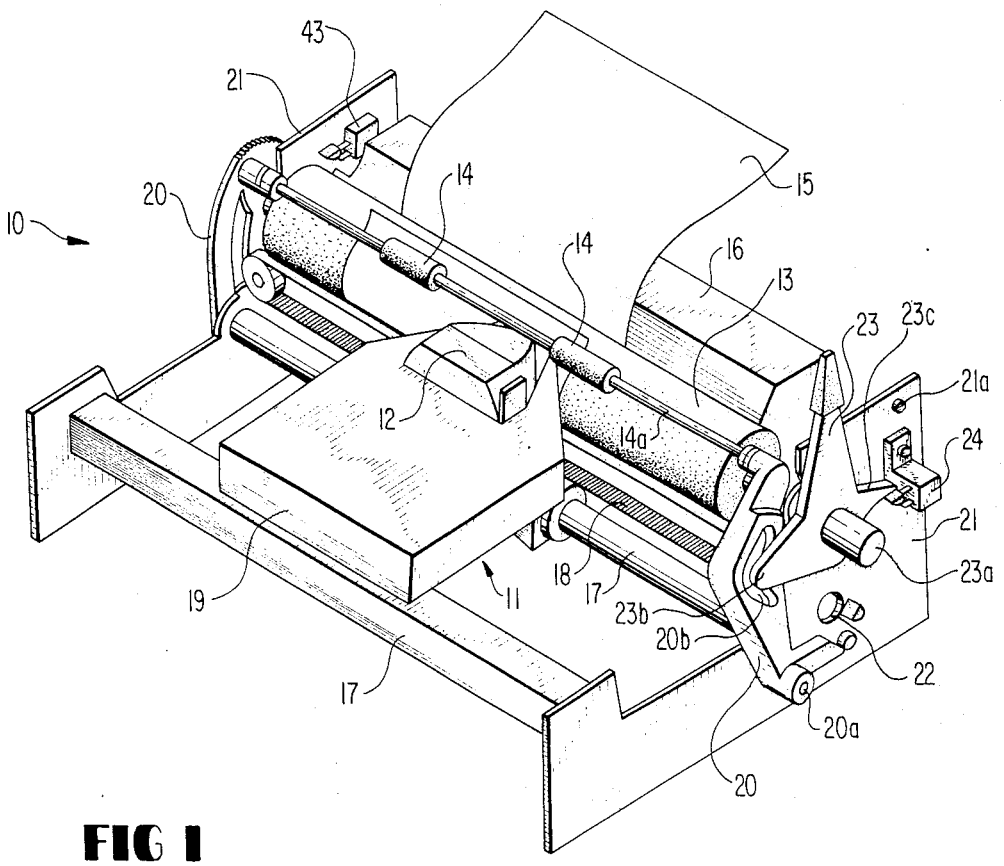
FIG. 1 is a perspective view of the print unit of a serial printer according to an embodiment of the present invention.

Referring to FIG. 1, a print unit 10 of the printer according to an embodiment of the present invention includes a carrier unit 11 on which a printing mechanism 12 is mounted, a cylindrical platen 13 opposed to the printing surface of the printing mechanism 12, bail rollers 14 fixed to a roller shaft 14*a* for pressing a print sheet 15 onto the face of the platen 13, and a guide member 16 for guiding the sheet 15 to the platen 13. The carrier unit 11 engages guide shafts 17 and is laterally moved by a spacing belt 18. The carrier unit 11 also includes a inked ribbon cassette 19 for supplying a inked ribbon to the printing mechanism 12.

The roller shaft 14*a* is rotatably supported by two bail arms 20 which are provided rotatably on an internal frame 21 via rotational shafts 20*a*. The bail arm 20 is urged to the clockwise direction in FIG. 1 by a spring 22. One of the bail arms 20 has an L-shaped cam groove 20*b* on its side surface to engage the cam follower 23*b* of a bail lever 23. The bail lever 23 is rotatably provided on the frame 21 via a rotational shaft 23*a*. The rotational axes of the platen 13 and the bail lever 23 are located on the same line.

When the bail lever 23 is located at an upper position (first position) as shown in FIG. 1, the cam follower 23*b* is positioned at the bent portion of the L-shaped cam groove 20*b* to allow the bail arm 20 to come near the platen and thereby to urge the bail rollers 14 toward the platen 13. When the lever 23 is turned in the clockwise direction to a lower and far position (second position), the bail arm 20 is turned in the counterclockwise direction to remove the bail rollers 14 from the platen and to make the engaging piece 23*c* of the lever 23 turn on an actuating switch 24. Further, when the lever 23 is turned in the counterclockwise direction to a lower and near position (third position), the bail arm 20 is also turned in the counterclockwise direction and the engaging piece 23*c* is removed from the switch 24 to maintain the switch 24 turn off.

The operation of turning the lever 23 in the clockwise direction is carried out when a cut sheet is to be set on the print unit 10. When the switch 24 is turned on, the automatic cut-sheet setting operation is actuated. The cut-sheet setting operation includes feeding the cut sheet to a position where the first print line of the cut sheet is set in front of the printing mechanism 12, by means of the rotation of the platen 13 and the pressure rollers (not shown) provided below the platen 13. The relationship among the lever 23, the arm 20 and the switch 24 and the automatic cut-sheet setting operation are disclosed in more detail in the U.S. patent application Ser. No. 736,578, filed on May 21, 1985, entitled "AN AUTOMATIC SHEET-SETTING MECHANISM FOR A PRINTER" and assigned to the present assignee.

Figure 2:
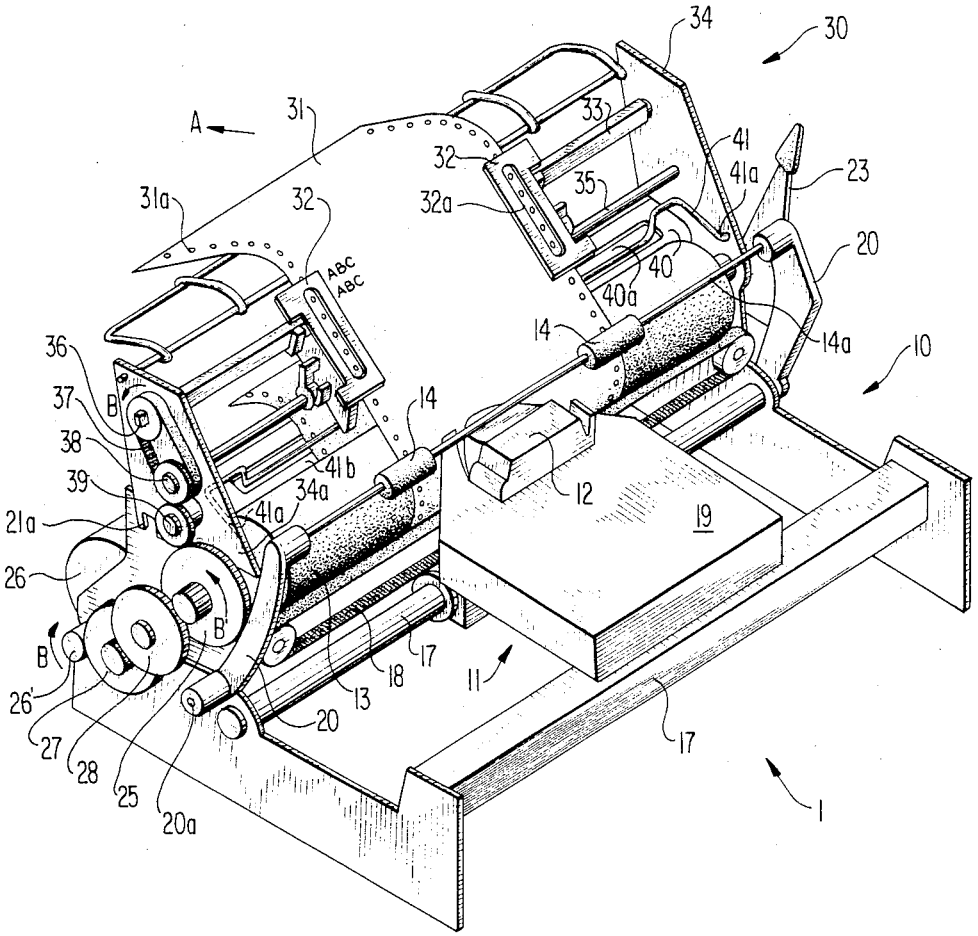
FIG. 2 is a perspective view of the print unit shown in FIG. 1 to which a tractor unit is attached.

Referring to FIG. 2, the platen 13 is rotatably supported on the frame 21 via its rotational shaft having a platen gear 25. A motor 26 has a gear 26' engaging the platen gear 25 via idle gears 27 and 28. In addition, pressure rollers 73 and 74 are rotatably provided so as to engage the lower circumference of the platen 13 (the rollers 73 and 74 will be described hereinafter with reference to FIGS. 5A and 5B).

A tractor unit 30 is mounted on the print unit 10 of the printer 1 with the lower portion engaging pins 21*a* and the platen shaft for supplying a continuous sheet 31 for the print unit 10. The continuous sheet 31 has a plurality of apertures 31*a* formed in line at its both edges. The tractor unit 30 has two tractor mechanisms 32 each having a plurality of protuberances 32*a* for engaging the apertures 31*a* so as to feed the continuous sheet 31. The tractor mechanisms 32 slidably engages a rotary shaft 33 rotatably supported on a tractor frame 34 and a guide shaft 35 fixed to the frame 34, so that the distance between two tractor mechanisms 32 may be changed corresponding to the width of the sheet 31.

As well known in the art, a set of the protuberances 32*a* are formed on a belt member which engages the rotary shaft 33. The shaft 33 has a pulley 36 fixed thereto. The pulley 36 engages the platen gear 25 via the belt 37, idle gears 38 and 39, all provided on the tractor frame 34. The idle gear 39 engages the platen gear 25 to receive the rotary force from the print unit 10 when the tractor unit 30 is attached on the print unit 10.

A guide plate 40 is fixed to the lower portion of the frame 34 for guiding the continuous sheet 31 to the platen 13 of the print unit 10. The guide plate 40 has a rectangular window 40*a* extending laterally at its central portion. A detecting bar 41 is coupled to the frame 34 at its both ends 41*a* such that the detecting bar 41 can rotate around the ends 41*a*. The detecting bar 41 has a bent portion 41*b* which is in supported contact with the sheet 31 when the sheet 31 is supplied with the print unit 10 and falls into the window 40*a* when the sheet 31 does not exist on the guide plate 40.

Figure 3A:
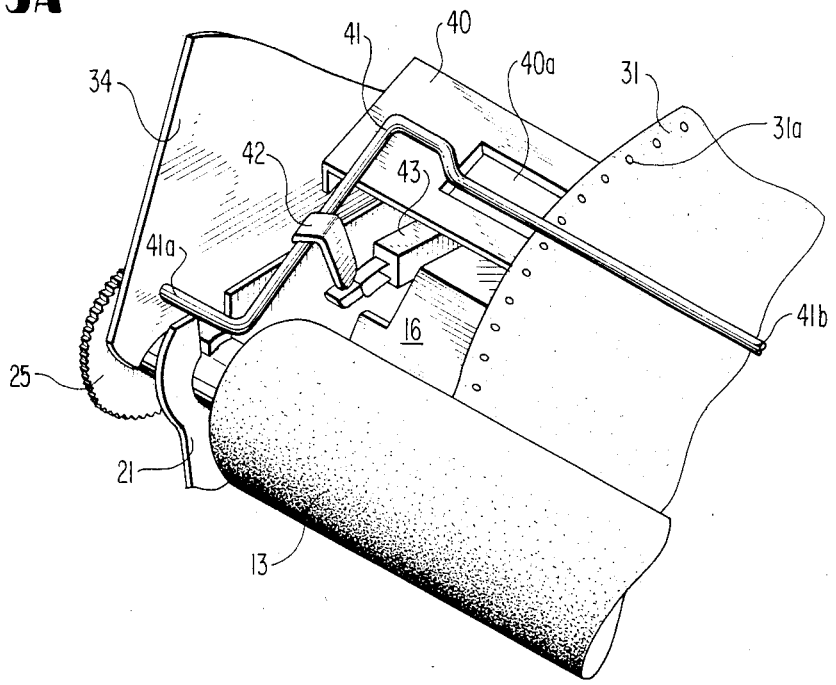
FIGS. 3A and 3B are perspective views showing a sheet detecting operation of the tractor unit shown in FIG. 2.
Figure 3B:
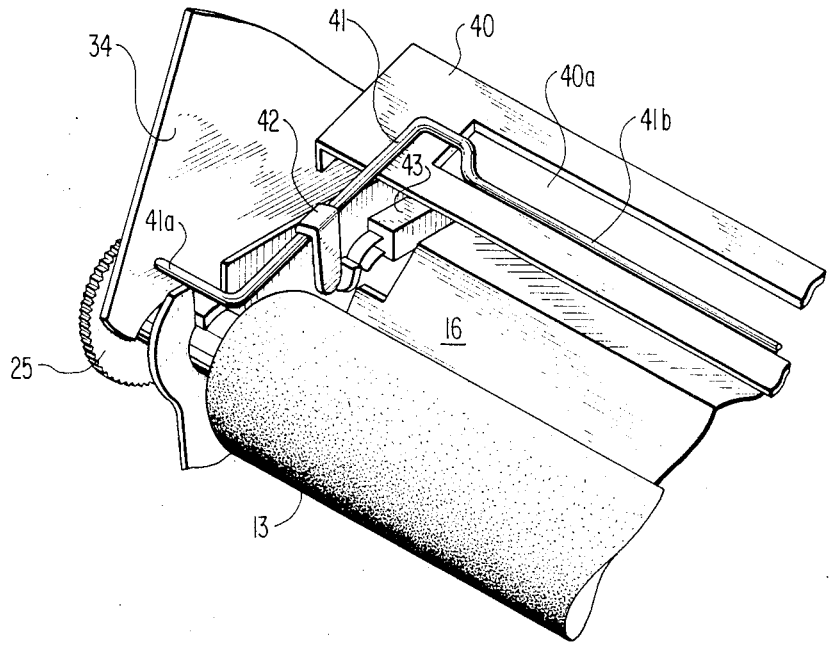

Referring to FIGS. 3A and 3B, the detecting bar 41 has a pawl 42 near one of the ends 41*a*. The pawl 42 actuates a sheet detecting switch 43 which is provided on the frame 21 of the print unit 10 (FIG. 1 is also referred). The switch 43 is turned off when the sheet 31 moves over the window 40*a* lifts the bar 41 up and prevents its falling into window 40*a* (FIG. 3A), while it is turned on when the sheet 31 does not cover the window 40*a* and the bent portion 41*b* falls into the window 40*a* (FIG. 3B).

Referring back to FIG. 2, the tractor frame 34 has a stopper portion 34*a* protruding forward to engage the upper portion of the bail arm 20 so that the bail arms 20 are turned in the clockwise direction in FIG. 2. The bail rollers 14 are removed from the platen 13 and the lever 23 is locked in the third position when the tractor unit 30 is attached on the print unit 10. Therefore, the actuating switch 24 (FIG. 1) is never turned on when the tractor unit 30 is attached to the printer unit 10.

The continuous sheet 31 passes between the guide plate 40 and the bent portion 41*b* and between the guide member 16 and the platen 13, winds around the platen 13 by about half turn, passes through the space between the bail rollers 14 and the platen 13, engages the tractor mechanisms 32 being pulled in the direction A, and runs out of the printer 1, in turn. The printing mechanism 12 prints characters on the sheet 31 at the position where the sheet 31 is wound on the platen 13. During the printing operation, the carrier unit 11 moves laterally to print in the line direction. After the printing is completed in one line, the motor 26 rotates in the direction B by a certain rotational angle so as to enable the platen 13 and the rotary shaft 33 to rotate in the direction B' and B", respectively. Accordingly, the platen 13 and the tractor mechanisms 32 advance the sheet 31 in the direction A by one line so that the printing mechanism 12 can print the next line.

When the tractor unit 30 is attached on the print unit 10 and the continuous sheet 31 is set on the tractor unit 30, the detecting switch 43 turns off and the actuating switch 24 always turns off. When all the sheet 31 has been fed and no longer covers the guide plate 40, the bar 41 falls into window 40*a* and detecting switch 43 turns on, as previously described. The tractor unit 30 can be replaced by a cut sheet feeding unit when it is desired that the print unit 10 print on a cut sheet.

Figure 4:
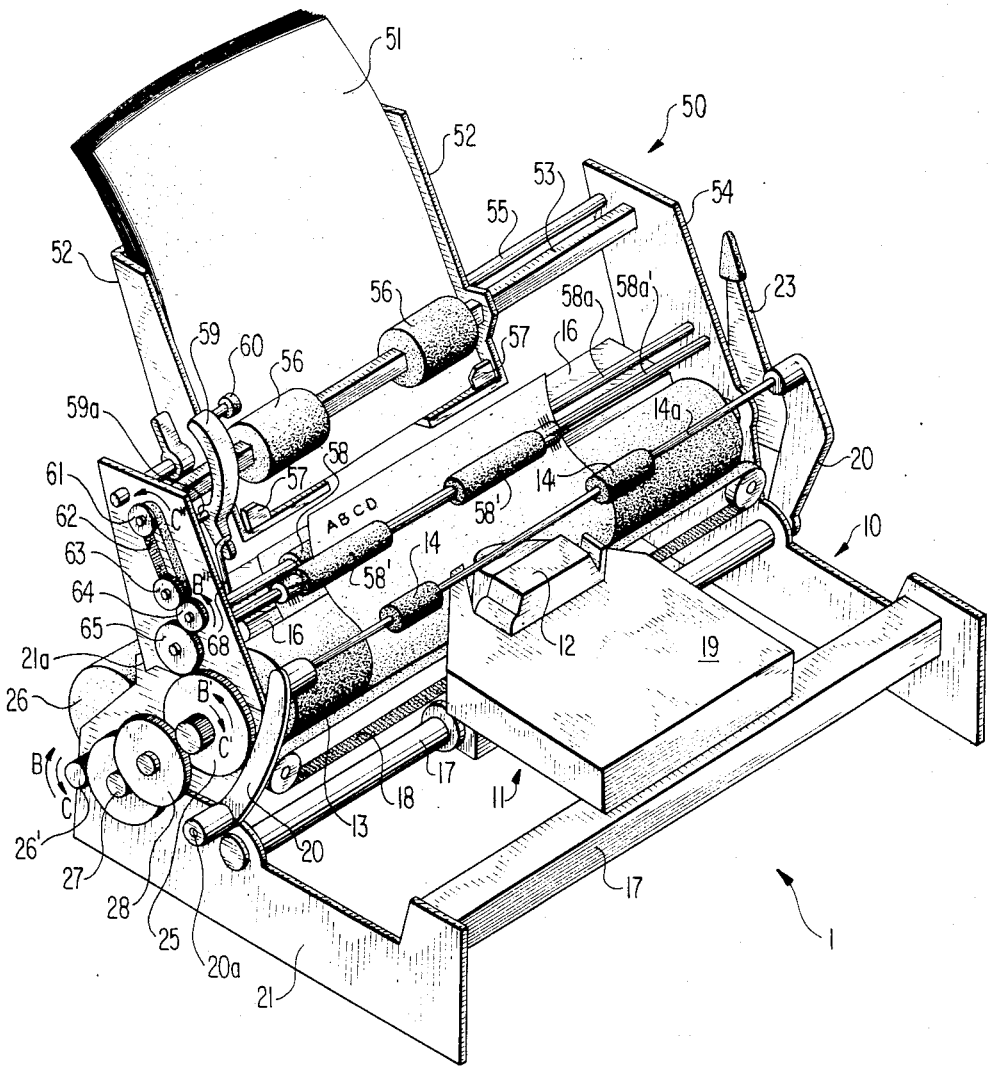
FIG. 4 is a perspective view of the print unit shown in FIG. 1 to which a cut sheet feeding unit is attached.

Referring to FIG. 4, a cut sheet feeding unit 50 is mounted on the print unit 10 of the serial printer 1 instead of the tractor unit 30 shown in FIG. 2. A plurality of cut sheets 51 are stacked in sheet stack housing members 52. The sheet stack housing members 52 slidably engage a rotary shaft 53 rotatably supported on the frame 54 of the cut sheet feeding unit 50 and a guide shaft 55 fixed to the frame 54 so that the distance between the housing members 52 is changeable corresponding to the width of the sheet 51. The rotary shaft 53 has two kick out rollers 56 located between the stack housing members 52 and engaging the upper sheet of the stacked sheets 51. Two separator pawls 57 are provided on the lower edge of the stack housing members 52 for separating the sheet picked up by the rollers 56 from others.

One of the sheets 51 is picked out from the stack housing members 52, fed toward the print unit 10 by the rollers 56, and inserted between the guide member 16 and the platen 13. Thus, one sheet is transported to the print unit 10 and wound around the platen 13. The sheet is fed by the platen 13 and the pressure rollers 73 and 74 (FIGS. 5A and 5B) provided below the platen 13 so as to pass through the gap between the bail rollers 14 and the platen 13. Then, the sheet is transported to the cut sheet feeding unit 50 again, and inserted between feed rollers 58 (only one is illustrated) and pressure rollers 58'. The feed rollers 58 and the pressure rollers 58' are rotatably provided on the frame 54 via a shaft 58*a* and 58*a'*, respectively, to feed the paper out of the printer 1.

Figure 5B:
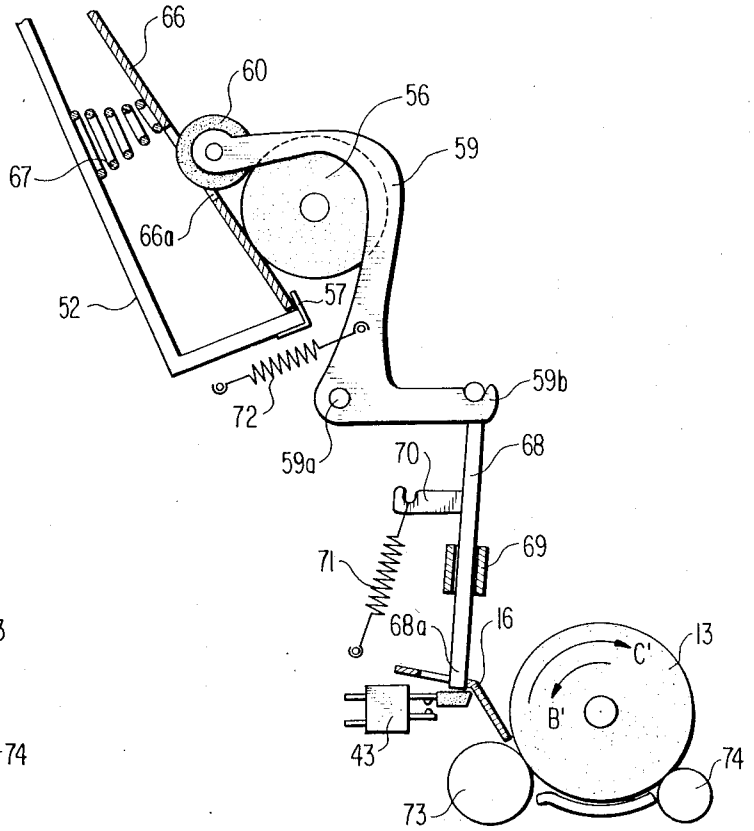
FIGS. 5A and 5B are side views showing a sheet detecting operation of the cut sheet feeding unit shown in FIG. 4.
Figure 5A:
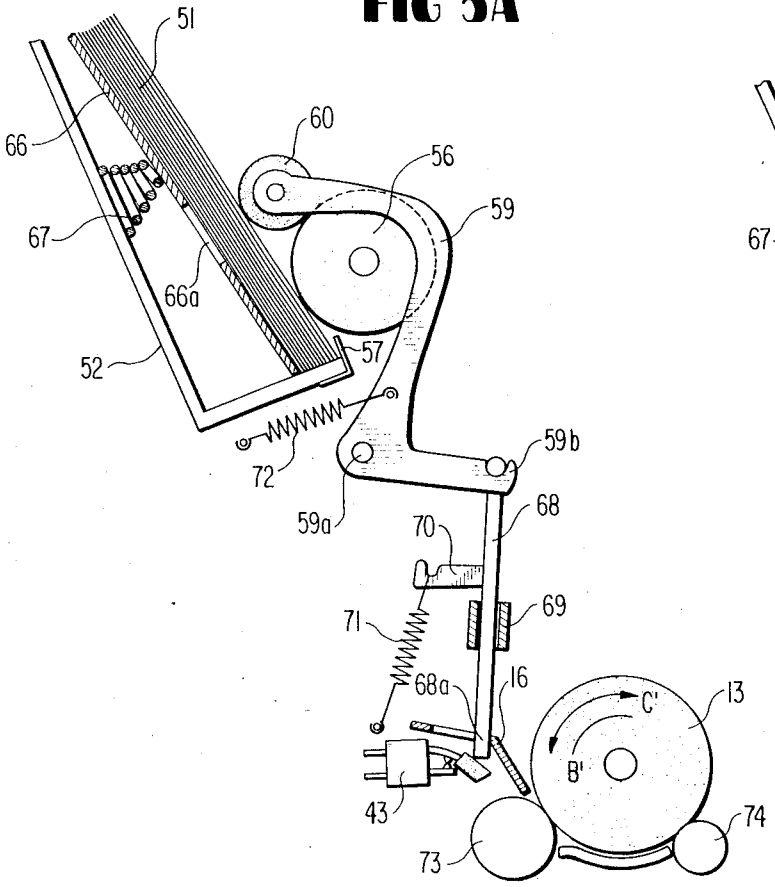

The detection lever 59 is rotatably supported on the frame 54 via a shaft 59*a* and urged in the counterclockwise direction in FIG. 3 by a spring 72 (FIg. 5A). The lever 59 has at its one end detection roller 60 pressing the stacked sheets 51 in the stack housing 52.

The rotary shaft 53 has a pulley 61 fixed thereto. The pulley 61 connects the platen gear 25 via a belt 62, an idle gear 63, a feed roller gear 64 and an idle gear 65, all provided on the frame 54. The feed roller gear 64 is fixed to the shaft 58*a* of the feed roller 58 to rotate the same. The idle gear 65 engages the platen gear 25 to receive the rotary force from the print unit 10 when the cut sheet feeding unit 50 is attached on the print unit 10.

The gear 64 and the pulley 61 include a one way cluch whereby only the rotations B'' and C'' are transmitted to the shafts 58*a* and 53, respectively. That is, when the motor 26 rotates in the direction B, the platen gear 25 rotates in the direction B', the feed rollers 58 are rotated in the direction B'' and the pulley 61 runs idle to enable the kick out rollers 56 to freely rotate. To the contrary, when the motor 26 rotates in the direction C, the platen gear 25 rotates in the direction C', the kick out rollers 56 are rotated in the direction C'' and the gear 64 runs idle to enable the feed rollers to freely rotate.

Referring to FIGS. 5A and 5B, a pressure plate 66 is provided behind the stacked sheets 51. A window 66*a* is formed at the position opposite to the detection roller 60. A spring 67 is provided on the bottom of the stack having 52 to push the plate 66 upwardly so that the plate 66 and the stacked sheets 51 are pressed against the detection roller 60 and the kick out roller 56.

The rotational shaft 59*a* of the detection lever 59 is located at the intermediate portion of the lever 59. An actuating arm 68 contacts the other end 59*b* of the lever 59 and is guided in the vertical direction by the guide member 69 provided on the frame 54. The actuating arm 68 has an another arm 70 engaging a spring 71. The spring 71 urges the arm 68 downward so that the lower end 68*a* of the arm 68 presses the detecting switch 43 provided on the printer unit 10.

As shown in FIG. 5A, when the sheets 51 are stacked in the housing 52, the detection roller 60 is pressed by the upper surface of the sheets 51 so that the lever 59 turns clockwise against the rotary force of the spring 72. Accordingly, the actuating arm 68 moves downward to make the switch 43 turn on.

As shown in FIG. 5B, when no cut sheet exists in the housing 52, the detection roller 60 falls into the window 66*a* of the plate 66 so that the lever 59 is permitted to turn counterclockwise by the spring 72 against the spring 71. Accordingly, the actuating arm 68 moves upward to make the switch 43 turn off.

Referring again to FIGS. 1 and 4, when the cut sheet feeding unit 50 is mounted, the bail lever 23 is turned in the clockwise derection in FIG. 1 to be located at the second position. The lever 23 is maintained locating at the second position until the cut sheet feeding unit 50 is removed. By thus turning on the switch 24, the automatic cut-sheet setting operation is carried out in the following manner.

With the actuating switch 24 turned on and the bail rollers 14 removed from the platen 13, the output of the switch 24 enables the motor 26 to rotate in the direction C. The rotation of the motor 26 is sequentially transmitted to the platen gear 25, the feed roller gear 64 and the pulley 61 to rotate them in the directions C', reverse to B'', and C'', respectively. Accordingly, the kick out rollers 56 rotates in the direction C'' to pick up the upper sheet of the stacked sheets 51 to transport the sheet to the print unit 10.

Next, the motor 26 stops when the leading edge of the sheet has run against the engaging position between the platen 13 and the pressure roller 73 (FIGS. 5A and 5B), and then, rotates reversely in the direction B to make the platen 13 rotate in the direction B' and the feed rollers 58 in the direction B''. The platen 13 further feeds the sheet in the direction B' together with the pressure rollers 73 and 74. As mentioned above, since the rotation of the motor 26 in the direction B is not transmitted to the rotary shafts 53, the kick out rollers 56 rotate in the reverse direction to C'' following the sheet feeding direction.

Then, the motor 26 stops when the sheet has been fed at the position where the first line to be printed is opposite to the printing mechanism 12. After the automatic cut-sheet setting operation is thus finished, the print unit 10 is ready for printing. The lever 23 is maintained at the second position, and in the printing mode, the carrier unit 11, the printing mechanism 12 and the motor 26 for rotating the platen 13 are actuated in the same manner described with reference to FIG. 2.

When the leading edge of the sheet is further advanced by the platen 13 and the pressure rollers 73 and 74, the sheet is inserted between the feed rollers 58 and the pressure rollers 58'. The feed rollers 58 is rotated in the direction B'' to further feed the paper to a location external of the printer 1.

Finally, the motor 26 continuously rotates after the last line of the sheet has been printed. The printed sheet is fed by the feed rollers 58 to transport out of the printer 1. The print unit 10 actuates the cut sheet feeding unit 50 so that the next cut sheet is automatically transported to the print unit 10.

When the cut sheet feeding unit 50 is attached on the print unit 10 and the cut sheets are set in the stack housing 52, the detecting switch 43 turns on, and then, the actuating switch 24 turns on. When all the cut sheets 51 are utilized and absent in the stack housing 52, the detecting switch 43 turns off to inform the lack of the cut sheets, while the switch 24 remains on.

As shown in FIG. 1, the print unit 10 alone can print characters on a sheet 15, even if no sheet-supplying unit is attached thereto. In this case, the cut sheet 15 should be manually inserted between the guide member 16 and the platen 13 until the leading edge of the sheet 15 runs against the contacting portion of the platen 13 and the pressure roller 73. The bail lever 23 is operated to turn in the clockwise direction to the second position to start the automatic sheet setting operation. When the sheet 15 is set on the platen 13, the bail lever 23 is operated in the counterclockwise direction to turn back to the first position. Accordingly, the bail rollers 14 are pressed onto the platen 13 and the engaging piece 23*c* is removed from the switch 24. The leading portion of the sheet 15 is pressed onto the platen 13 by the bail rollers 14.

The sheet 15 is intermittently fed line by line as each line of printing is completed in the printing mode, and then, continuously fed to run out of the print unit 10 by the platen 13, the pressure rollers 73 and 74, and the bail rollers 14.

When the print unit 10 is utilized alone as a printer without the sheet-supplying unit, the detecting switch 43 maintains its off-state, and the actuating switch 24 is once turned on and then turned off.

In summary, the actuating switch 24 and the detecting switch 43 takes in combination the following four states:

| State | Detecting Switch 43 | Actuating Switch 24 |
|---|---|---|
| I | OFF | OFF |
| II | ON | OFF |
| III | OFF | ON |
| IV | ON | ON |

Figure 6:
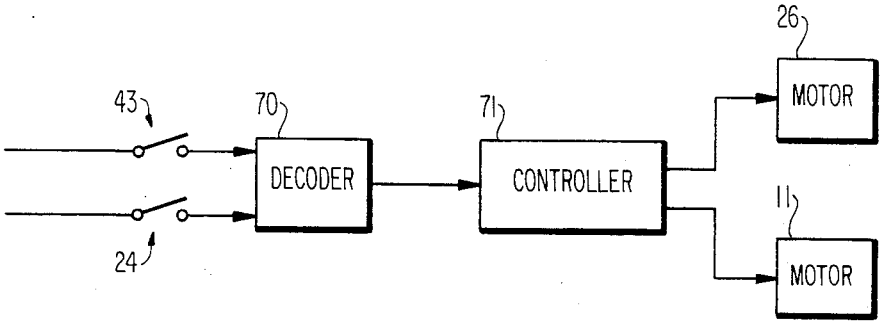
FIG. 6 is a block diagram of the print unit shown in FIG. 1.

Referring to FIG. 6, the actuating switch 24 and the detecting switch 43 are connected to a decoder 70. The controller 71 of the main unit 10 recognizes the states of the switches 24 and 43, as decoded by the decoder 70, and carries out the drive control of the motor 26 and the carrier unit 11 in response to the states of the switches 24 and 43.

In general, when the operation of printer 1 is started, the continuous sheet 31 or the cut sheet 51 is always set on the tractor unit 30 or the cut sheet feeding unit 50. If not, the operator can easily discover the absence of the sheet 31 or 51 and place the sheet 31 or 51 on the unit 30 or 50 before he turns on the electric source of the printer 1. Accordingly, we can suppose that the sheet 31 or 51 is present on the tractor unit 30 or the cut sheet feeding unit 50 initially.

When the tractor unit 30 is mounted on the print unit 10, the switches take State I. The controller 71, when it recognizes the State I, makes the motor 26 and the carrier unit 11 ready for printing. Upon receipt of a print instruction signal and character signal from the outside, the printer 1 starts the printing operation. In this case, the motor 26 keeps operating to feed the sheet 31 until the controller 71 detects the state II. If all of the continuous sheet 31 is utilized by the printing operation, the switches turn to take State II and the operations of the motor 26 and the carrier unit 11 are stopped.

When the cut sheet feeding unit 50 is mounted on the print unit 10, the switches take State II in which the controller 71 forbids the operations of the motor 26 and the carrier unit 11. Then, the switches take State IV, when the bail lever 23 is operated to move to the second position, for the cut-sheet feeding operation. If the lever 23 is turned to the second position before the electric power switch (not shown) is turned on, the switches initially take the State IV. When the controller 71 recognizes the State IV, the automatic cut-sheet feeding operation is done and the printer 1 is ready for printing. In this case, in printing operation, the motor 26 performes the sheet-feeding operation such that one sheet is intermittently moved and, after one sheet is printed out, another sheet is fed to the printer unit 10. When all the cut sheets 51 in the stack housing 52 are utilized, the switches turn to take State III in which the printing operation is stopped.

In a manual cut-sheet loading mode in which neither the tractor unit 30 nor the cut sheet feeding unit 50 is attached on to the print unit 10, the switches take State I. Although the printer unit 10 is ready for printing, no print instruction signal is applied thereto and, therefore, it does not start the printing operation. When the cut sheet 15 is manually set on the print unit 10 and the bail lever 23 is operated to turn to the second position for the automatic cut-sheet setting operation, the switches take State III in which the printing operation is stopped but automatic cut-sheet setting operation is done. Next, the switches return to take State I after the lever 23 turns back to the first position, and then, the print unit 10 is ready for printing. The controller 71, by detecting the change of the States I to III or III to I, recognizes the manually loaded cut-sheet printing and stops printing after one sheet is printed out.

In summary, the controller 71 of the print unit 10 can recognize that the tractor unit 30 is attached thereon when the switches take and maintain State I. The absence of the continuous sheet 31 can be detected by the change of the state of the switches from State I to State II.

The cut sheet feeding unit 50 can be recognized by detecting the change of the state of the switches from State II to IV or by detecting State IV. The absence of the cut sheet 31 is detected by the change from State IV to State III.

Further, the manual insertion mode, i.e., the mode if no sheet-supplying unit is attached on to the print unit, is recognized by the change from State I to III or State III to I.

As described above, the detecting switch for detecting the presence or absence of the sheet is provided on the print unit of the printer. That switch takes the reverse state when the attached sheet-supplying unit is changed between the tractor unit and the cut sheet feeding unit. Therefore, the print unit recognizes the kind of the sheet-supplying unit in accordance with the combination of the detecting switch and the actuating switch for the automatic sheet setting operation. As a result, the signal lines can be omitted from the sheet supplying units for recognizing the kind of sheet supplying units and detecting the presence or absence of the sheet.

What is claimed is:

1. A printer comprising:

printing means capable of printing on a sheet;

automatic sheet setting means for feeding said sheet to said printing means;

actuating switch means adapted to take either a first or second state and for enabling said automatic sheet setting means to operate in said first state;

receiving means adapted to receive first and second sheet-supplying units;

detecting switch means operated by each one of said sheet-supplying units and adapted to take third and fourth states in response to the attachment of said first and second sheet-supplying units, respectively; and determining means responsive to said actuating switch means and said detecting switch means for determining one of a first condition that said first sheet-supplying unit is attached to said receiving means, a second condition that said second sheet-supplying unit is attached to said receiving means and a third condition that neither of said first and second sheet-supplying units is attached to said receiving means by the combination of the states of said actuating switch means and said detecting switch means.

2. A printer comprising:

printing means capable of printing on a sheet;

automatic sheet setting means for feeding said sheet to said printing means;

actuating switch means adapted to take either a first or a second state and being operatively connected to said automatic sheet setting means for enabling the operation of said means in said first state;

sheet-supplying means for supplying said sheet in front of said printing means;

detecting switch means operatively connected to said sheet supplying means and adapted to take a third or a fourth state said sheet supplying means having detection means adapted to contact said sheet and to detect the presence or absence of said sheet, said detection means being operatively connected to said detecting switch means; and determining means connected to said actuating switch means and said detecting switch means for determining the kind of the received sheet-supplying means by the states of said actuating switch means and said detecting switch means.

3. The printer as claimed in claim 2, wherein said sheet supplying means is a tractor means for supplying a continuous sheet to said printing means, said detection means enabling said detecting switch means to take said third state when said continuous sheet is present and to take said fourth state when said continuous sheet is absent.

4. The printer as claimed in claim 3, said tractor means further having a guide plate for guiding said continuous sheet to said printing means, said guide plate having a window over which said continuous sheet passes, and said detection means pressing said continuous sheet onto said guide plate at the position where said window is formed.

5. The printer as claimed in claim 2, wherein said sheet supplying means is a cut sheet feeding means for supplying a cut sheet to said printing means, said detection means enabling said detecting switch means to take said fourth state when said cut sheet is present and to take said third state when said cut sheet is absent.

6. The printer as claimed in claim 3, said printing means further having a platen for feeding said continuous sheet in the printing operation, a platen gear provided on said platen, and a motor engaging said platen gear for rotating said platen.

7. The printer as claimed in claim 6, said tractor means further having a tractor mechanism engaging said continuous sheet to feed the same, a first rotary shaft engaging said tractor mechanism, and a first feed gear connecting said first rotary shaft, said first feed gear engaging said platen gear to receive the rotary force of said motor.

8. A printer comprising:

a printing means capable of printing on a cut sheet;

an automatic sheet setting means for feeding said cut sheet to said printing means; and a cut sheet supplying means for supplying said cut sheet in front of said printing means, said cut sheet supplying means having detection means adapted to contact said cut sheet and to detect the pressure of absence of said cut sheet, a stack housing means for storing a plurality of cut sheets and a pressure plate means located at the lower portion of said cut sheets in said stack housing means for pressing said cut sheets upward, said pressure plate means having a window on which said cut sheets are stacked, and said detection means being adapted to press said cut sheets downward at the position where said window is formed.

9. A printer comprising:

a printing means capable of printing on cut sheets, said printing means having a platen for feeding said cut sheets in the printing operation, a platen gear provided on said platen, and a motor engaging said platen gear for rotating said platen;

an automatic sheet setting means for feeding said cut sheets to said printing means, said automatic sheet setting means including actuating switch means adapted to take either a first or a second state and operatively connected to said automatic sheet setting means for enabling the operation of said automatic sheet feeding means in said first state;

a cut sheet supplying means having detection means adapted to contacting said sheets and to detect the presence or absence of said cut sheets, a kick out roller for picking up one of said cut sheets, a rotary shaft having said kick out roller, and a feed gear connecting said rotary shaft, said feed gear engaging said platen gear of said printing means to receive the rotary force of said motor; and detecting switch means operatively connected to said detection means of said cut sheet feeding means and adapted to take a third or a fourth state.

* * * * *

UNITED STATES PATENT AND TRADEMARK OFFICE

CERTIFICATE OF CORRECTION

PATENT NO. : 4,655,626

DATED : April 7, 1987

INVENTOR(S) : R. OKAZAKI

It is certified that error appears in the above-identified patent and that said Letters Patent is hereby corrected as shown below:

| | |
|---|---|
| COLUMN 1, LINE 25 | Before "each" insert --after--; |
| COLUMN 3, LINE 14 | Delete "a" both occurances and insert --an-- at both occurances; |
| COLUMN 5, LINE 41 | Delete "(FIg" insert --FIG--; |
| COLUMN 5, LINE 68 | Delete "having" insert--housing--; |
| COLUMN 6, LINE 8 | Delete "an"; |
| COLUMN 10, LINE 28 | Delete "pressure" insert --presence-- |
| COLUMN 10, LINE 29 | Delete "of" (first occurrence) and insert --or--. |

Signed and Sealed this

Seventeenth Day of May, 1988

*Attest:*

*Attesting Officer*

DONALD J. QUIGG

*Commissioner of Patents and Trademarks*